US005267689A

United States Patent [19]

Forer

[11] Patent Number: 5,267,689

[45] Date of Patent: Dec. 7, 1993

[54] ROTARY SPRINKLER HEAD HAVING INDIVIDUALLY-ADJUSTABLE DEFLECTOR PLATES FOR WATERING IRREGULARLY-SHAPED AREAS

[76] Inventor: Karl Forer, 8291 E. Jamison Pl., Englewood, Colo. 80112

[21] Appl. No.: 58,028

[22] Filed: May 5, 1993

[51] Int. Cl.[5] ..... B05B 3/08

[52] U.S. Cl. ..... 239/11; 239/206; 239/230; 239/231; 239/DIG. 1

[58] Field of Search ..... 239/11, 97, 98, 206, 239/230-233, 236, DIG. 1

[56] References Cited

U.S. PATENT DOCUMENTS

| | | | |
|---|---|---|---|
| 129,125 | 7/1872 | Gibson | 239/236 |
| 1,593,918 | 7/1926 | Stanton . | |
| 1,997,901 | 4/1935 | Englehart . | |
| 2,530,779 | 11/1950 | Owbridge | 239/231 |
| 2,999,643 | 9/1961 | Kennedy | 239/97 |
| 3,009,651 | 11/1961 | Wolf | 239/230 |
| 3,268,173 | 8/1966 | Costa | 239/206 |
| 3,272,437 | 9/1966 | Coson | 239/206 |
| 3,528,093 | 9/1970 | Eerkens | 239/97 |
| 3,703,993 | 11/1972 | Schreiner | 239/231 |
| 3,878,990 | 4/1975 | Geraudie | 239/236 |
| 3,952,954 | 4/1976 | Taylor | 239/236 |
| 4,281,793 | 8/1981 | DeWitt | 239/11 |
| 4,453,673 | 6/1984 | Icenbice | 239/236 |
| 4,538,762 | 9/1985 | Lemkin | 239/232 |
| 4,540,125 | 9/1985 | Gorney et al. | 239/232 |
| 4,637,549 | 1/1987 | Schwartzman | 239/230 |
| 4,984,740 | 1/1991 | Hodge | 239/232 |
| 5,031,840 | 7/1991 | Grundy et al. | 239/456 |

*Primary Examiner*—Karen B. Merritt
*Attorney, Agent, or Firm*—William E. Hein

[57] ABSTRACT

A deflector cap for use in connection with a conventional pop-up or other type of rotary sprinkler head is held in a fixed angular position with respect to the sprinkler head housing by means of a downwardly extending rod that slides within a tube fixedly attached to the sprinkler head housing. An annular array of individually-adjustable, wedge-shaped, flat deflector plates is mounted to the underside of the deflector cap. Each of the deflector plates is formed to have an outer wide end and an inner narrow end. The inner end of each of the deflector plates is hingedly attached to the deflector cap at a uniform radial distance from the center of the deflector cap, thereby permitting vertical movement of the outer ends of each of the deflector plates. Vertical movement of the individual deflector plates is facilitated by a screw adjustment mechanism associated with each of the deflector plates. A thin annular sheet of mylar or other flexible material is attached to the underside of the array of deflector plates adjacent the outer ends thereof to provide a smooth water stream transition as the rotating nozzle of the sprinkler head rotationally passes beneath each of the deflector plates. As the nozzle of the sprinkler head rotates during operation, the water stream emitted therefrom will be deflected to varying distances by each of the deflector plates in turn as a function of the arcuate or rotational position of the nozzle in accordance with the vertical adjustment previously made to each of the individual deflector plates.

6 Claims, 1 Drawing Sheet

ROTARY SPRINKLER HEAD HAVING INDIVIDUALLY-ADJUSTABLE DEFLECTOR PLATES FOR WATERING IRREGULARLY-SHAPED AREAS

BACKGROUND AND SUMMARY OF THE INVENTION

This invention relates generally to automatic sprinkler systems and more specifically to an improved sprinkler head that may adjusted by the user to direct the flow of water over a ground area to be watered that is irregular in shape. A number of rotary lawn sprinklers are known in the prior art for watering residential and commercial lawn areas, greenbelts, golf courses, and other grass areas of varying size. U.S. Pat. No. 3,268,173 is directed to a conventional pop-up sprinkler head that rotates to water a circular area represented by a fixed radial distance from the sprinkler head. U.S. Pat. No. 1,997,901 to Englehart is directed to a rotary sprinkler having a fixed base supporting a vertical stem around which a water stream expelling nozzle driven by an impact arm is caused to rotate either continuously or back and forth between arcuate stop positions to water either a complete circular area or a circular sector area. The water stream exiting the nozzle of this prior art sprinkler strikes an adjustable deflector plate fixedly attached to the nozzle assembly, thereby allowing the user to set the fixed radius of the full circle or circular sector being watered.

Oftentimes, the area being watered by such sprinklers is irregular in shape so that directing a stream of water over full circle or circular sector areas either results in watering areas not intended to be watered or in missing areas that are in need of water. Both of these situations are undesirable. Several prior art sprinklers provide non-circular watering patterns that may be selected by the user. U.S. Pat. No. 2,999,643 to Kennedy is directed to a rotary sprinkler employing a complex cam arrangement for adjusting the watering pattern of the sprinkler. U.S. Pat. No. 4,984,740 to Hodge is directed to a rotary sprinkler that emits a stream whose distance is adjustable by means of a series of adjustable sliding blocks that controls the position of a flap on which the emitted stream impinges. U.S. Pat. No. 3,528,093 is directed to a rotary sprinkler in which a cam arrangement is provided to permit watering of an area that is square in shape. U.S. Pat. No. 3,272,437 to Coson is directed to a rotary sprinkler in which a cam arrangement is provided to permit watering a delineated circular sector. U.S. Pat. No. 3,952,954 is directed to a rotary sprinkler in which the speed of rotation of the nozzle and the angle of elevation of the water stream emitted by the nozzle are controlled to distribute water over an irregular pattern. U.S. Pat. No. 1,593,918 to Stanton is directed to a rotary sprinkler in which the emitted stream of water may be confined within a square area or one bordered by straight lines. U.S. Pat. No. 4,281,793 to DeWitt is directed to a rotary sprinkler in which a mechanism is provided for altering the volume of water flow to the spray head to thereby define the watering pattern on the ground. U.S. Pat. No. 4,453,673 to Icenbice is directed to a rotary sprinkler in which a cam plate is provided to control the range of the water stream emitted from the sprinkler. U.S. Pat. No. 4,637,549 is directed to a rotary sprinkler in which rotation speed and a splash plate control the distance that the water stream will project from the water nozzle outlet. U.S. Pat. No. 4,538,762 to Lemkin is directed to a rotary sprinkler in which a cam arrangement is provided to permit adjustment of the watering pattern. U.S. Pat. No. 5,031,840 to Grundy et al. is directed to a rotary sprinkler in which dual nozzles, one of which employs radial channels therein, are employed to control the radius of the water stream emitted from the sprinkler. U.S. Pat. No. 4,540,125 is directed to a rotary sprinkler employing a first cam apparatus for controlling a water deflector to thereby select an overall size and pattern of sprinkler stream coverage and a second cam apparatus for determining the desired sprinkling pattern as a function of the azimuthal orientation of the nozzle. The foregoing prior art sprinklers typically involve complex mechanisms that are expensive and do not permit easy adjustment of the stream distance by the user. They are generally not retrofittable to previously installed sprinklers, and some are not adaptable to a pop-up type of rotary sprinkler.

It is therefore the principal object of the present invention to provide a rotary water sprinkler in which a simple mechanical arrangement is employed to permit the user to quickly and easily adjust the distance of the emitted stream of water at various arcuate positions of a full circle or circular sector of rotation of the sprinkler.

This and other incidental objects are accomplished in accordance with the illustrated preferred embodiment of the present invention by providing a deflector cap that may replace the plain cap of a conventional pop-up rotary sprinkler head previously installed or be incorporated into customary pop-up rotary sprinkler heads. The deflector cap is held in a fixed angular position with respect to the sprinkler housing by means of a downwardly extending rod that slides within a tube fixedly attached to the sprinkler housing. An annular array of individually-adjustable, wedge-shaped, flat deflector plates is mounted to the underside of the deflector cap. Each of the deflector plates is formed to have an outer wide end and an inner narrow end. The inner end of each of the deflector plates is hingedly attached to the deflector cap at a uniform radial distance from the center of the deflector cap, thereby permitting vertical movement of the outer ends of each of the deflector plates. The vertical movement is facilitated by a screw adjustment mechanism associated with each of the deflector plates. A thin annular sheet of mylar or other flexible material is attached to the underside of the array of deflector plates adjacent the outer ends thereof to provide a smooth water stream transition as the rotating nozzle of the sprinkler rotationally passes each of the deflector plates. As the nozzle of the sprinkler rotates during operation, the water stream emitted therefrom will be deflected to varying distances by the deflector plates as a function of the angular position of the nozzle in accordance with the vertical adjustment previously made to each of the individual deflector plates.

DETAILED DESCRIPTION OF THE PREFERRED EMBODIMENT

Figure 1:
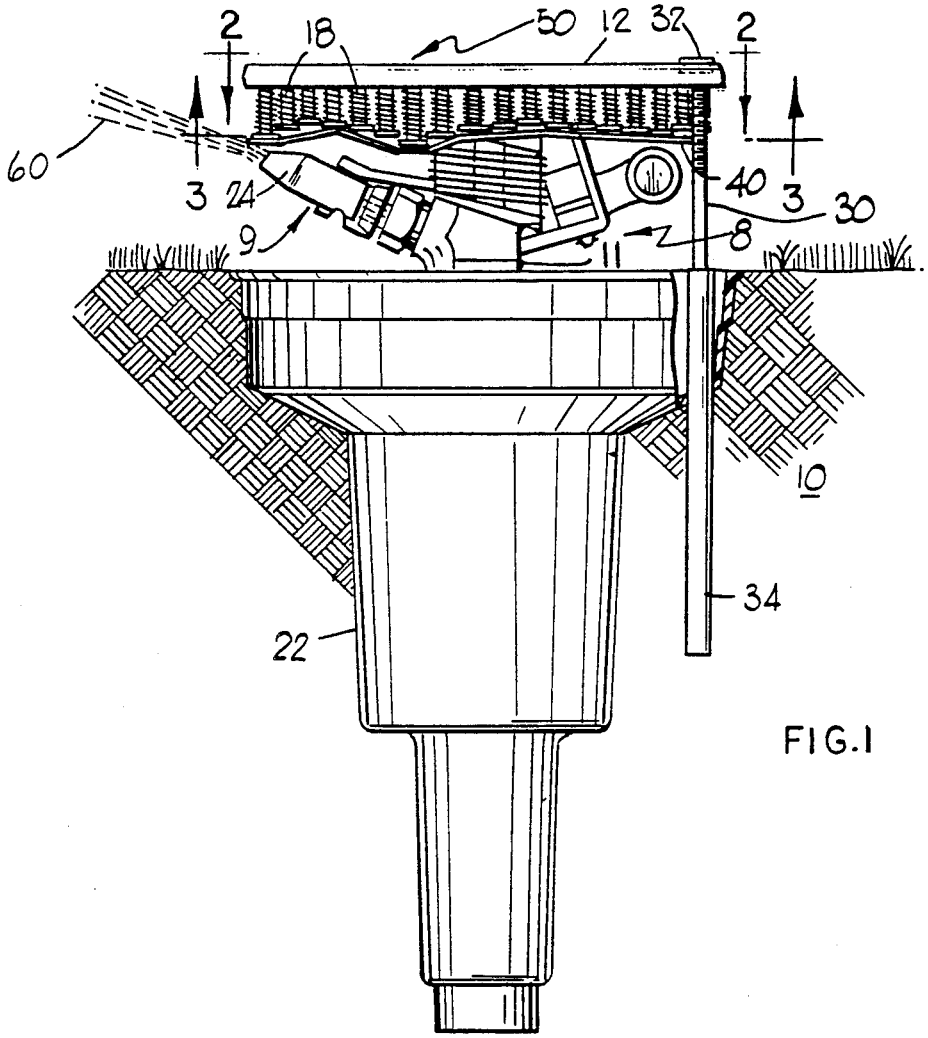
FIG. 1 is a pictorial diagram illustrating a pop-up rotary sprinkler as it is typically installed for operation as part of an underground sprinkling system, the rotary sprinkler being configured with a water stream deflector mechanism constructed in accordance with the present invention.
Figure 2:
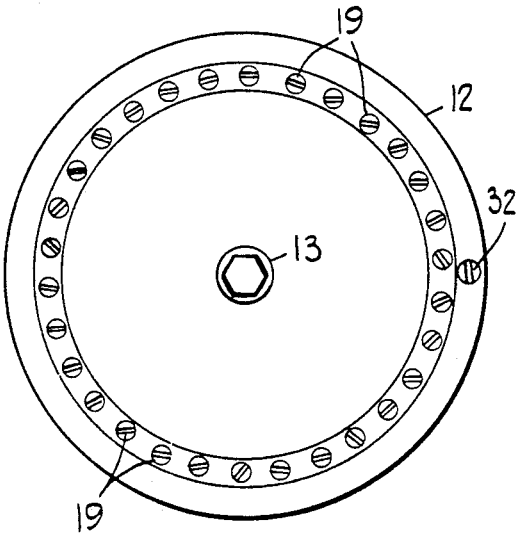
FIG. 2 is a view of the sprinkler of FIG. 1 taken along the line 2—2 of FIG. 1.

Referring now to FIG. 1, there is shown a typical pop-up rotary sprinkler 10 equipped with a water deflector cap 50 of the present invention to provide easy adjustment by the user of the distance of the emitted stream of water with respect to the rotational or arcuate position of the rotary head of the sprinkler 10. Sprinkler 10 is contained within a housing 22 positioned in the earth and may comprise, for example, a sprinkler of the type described in U.S. Pat. No. 3,268,173 to Costa. Such a sprinkler includes a conventional pop-up, impact-arm driven sprinkler mechanism assembly 8 that, in turn, includes a nozzle assembly 9 positioned for rotation around a fixed vertical stem 11. Nozzle assembly 9 may be set to rotate either continuously or reciprocally between arcuate stop positions. The mechanism for selecting either the continuous or reciprocal mode of operation is conventionally provided on commercially available rotary sprinklers. A deflector cap 12 is fitted on top of the sprinkler mechanism assembly 8 by means of a nut 13, illustrated in FIG. 2. Nut 13 is cylindircally shaped and internally threaded so as fit within a hole in the center of deflector cap 12. Nut 13 screws onto an externally threaded protrusion at the top of the sprinkler mechanism assembly 8.

Figure 3:
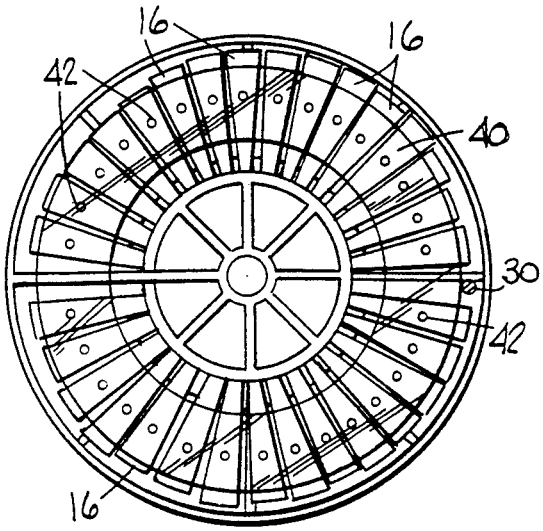
FIG. 3 is a view of the sprinkler of FIG. 1 taken along the line 3—3 of FIG. 1.

In conventional rotary sprinklers, a single adjustable deflector plate is mounted to nozzle assembly 9 for rotation in concert therewith. This single deflector plate may be adjusted by the user to deflect the stream of water emitted by the sprinkler so that the stream travels a fixed radial distance from the sprinkler 10 over the entire circle of rotation of nozzle assembly 9. As stated above, a rotary sprinkler that emits a stream that travels a fixed, albeit adjustable, distance irrespective of the arcutate position of the sprinkler head, is disadvantageous in that it does not facilitate watering of irregularly shaped areas. In the illustrated sprinkler 10 of the present invention, this single prior art deflector plate has been eliminated and replaced by an annular array of individually-adjustable, wedge-shaped, flat deflector plates 16 mounted to the underside of deflector cap 12, as illustrated in FIG. 3. Each of the deflector plates 16 includes an outer wide end and an inner narrow end. The outer ends are aligned near the outer periphery of deflector cap 12, and the inner ends are hingedly mounted at a uniform radius from the center of deflector cap 12. By hingedly mounting each of the deflector plates 16 at their inner ends on the underside of deflector cap 12, vertical movement of the outer ends of deflector plates 16 is permitted. Hinged mounting of the deflector plates 16 may be accomplished by any of several known fabrication processes. For example, a circular wire may provided on the underside of deflector cap 12 to which the inner end of each of the deflector plates 16 is hinged. Alternatively, the deflector plates 16 may be molded integrally with deflector cap 12 from a plastic material such that the plastic material itself acts as a hinge at the point of attachment between each one of the deflector plates 16 and deflector cap 12. Each of the individual deflector plates 16 is associated with an adjustment mechanism 18 to provide vertical adjustment of the outer end of that deflector plate. Each of the deflector plate adjustment mechanisms 18 is mounted between its associated one of the deflector plates 16 and the underside of deflector cap 12. Each of the deflector plate adjustment mechanisms 18 is controlled by an adjusting screw 19 that is accessible on the top surface of deflector cap 12. Each of the adjusting screws 19 is preferably fabricated of a non-rusting material such as brass or stainless steel. Each of the deflector plate adjustment mechanisms 18 may comprise any of a number of well-known screw adjustment mechanisms. For example, a pair of springs of different diameter, coaxially positioned one within the other, may be provided in the space between deflector cap 12 and each of the deflector plates 16. The inner spring, for example, may be fixedly attached to its associated deflector plate 16, while the outer spring is fixedly attached to its associated adjusting screw 19. A lateral protrusion formed by the first coil of the inner spring tracks the coils of the outer spring in a telescoping fashion as the associated adjusting screw 19 is turned by the user, thereby adjusting the vertical position of the associated deflector plate 16. The outer spring is slightly stretched to provide a gap between its adjacent coils to accommodate the lateral protrusion of the inner spring. The top or adjustment end of each of the adjusting screws 19 is preferably countersunk into the top surface of deflector cap 12 so as to be flush therewith.

As the nozzle assembly 9 moves through its rotational cycle, deflector cap 12 is held in a fixed angular position with respect to housing 22 by means of a shaft 30 that extends downward from deflector cap 12 into an aligned receptacle tube 34 mounted in sprinkler housing 22. In operation, the entire sprinkler mechanism assembly 8, including deflector cap 12, rises out of the buried housing 22 as water pressure is applied to sprinkler 10, in accordance with the teachings of the prior art. Shaft 30 moves upward within tube 34 as the sprinkler mechanism assembly 8, including deflector cap 12, rises out of housing 22. When the sprinkler mechanism assembly 8 reaches its upward or operating position, the bottom end of the shaft 30 remains within tube 34 to thereby prevent rotation of deflector cap 12 with respect to housing 22 as nozzle assembly 9 begins rotating in response to water pressure applied to sprinkler 10.

Referring now to FIGS. 1 and 3, a thin deflector plate cover 40 partially covers the underside of the circular array of deflector plates 16. Deflector plate cover 40 is annular in shape such that its outer periphery is substantially aligned with the outer periphery of the deflector plates 16. Deflector plate cover 40 is preferably fabricated of a thin, flexible material such as mylar and serves to bridge any gaps between adjacent ones of the deflector plates 16 near their outer ends. Thus, a water stream 60 emitted by a nozzle pipe 24 of rotating nozzle assembly 9 strikes the surface of deflector plate cover 40 rather than the deflector plates 16 themselves to provide a smooth water stream transition as the nozzle pipe 24 rotationally passes beneath each of the deflector plates 16, regardless of the gaps between adjacent deflector plates resulting from a desired vertical adjustment thereof. Deflector plate cover 40 is preferably held in place on the underside of the deflector plates 16 by a small mushroom-shaped protrusion 42 on the underside of each of the deflector plates 16. The protrusions 42 are arranged in a circular configuration, as illustrated in FIG. 3, and are adapted to matingly engage correpondingly positioned, slightly elongated holes in deflector plate cover 40 to thereby hold deflector plate cover 40 in place on the underside of the array of deflector plates 16. As the nozzle assembly 9 rotates during operation of sprinkler 10, the water stream emitted from nozzle pipe 24 will be deflected to varying distances by each of the deflector plates in turn as a function of the arcuate or rotational position of nozzle assembly 9, in accordance with the adjustment previously made to each of the individual deflector plates 16 by means of the associated adjusting screws 19.

The assembly of the present invention that comprises deflector cap 12, deflecting plates 16, cover 40, and deflector plate adjustment mechanisms 18 may be conveniently substituted for the plain cap of a conventional rotary sprinkler head of the type manufactured by Rainbird Corporation of Glendora, Calif., for example. Thus, the apparatus of the present invention may be incorporated into custom rotary sprinkler head designs or it may be used to retrofit existing off-the-shelf or previously installed rotary sprinkler heads.

I claim:

1. A rotary sprinkler for watering irregularly-shaped areas, the sprinkler comprising:

a frame member;

a vertical stem member fixedly attached to said frame member;

a rotating nozzle assembly coupled to said vertical stem member for emitting a stream of water outwardly from the sprinkler;

a circular deflector cap positioned above said rotating nozzle assembly and attached to said vertical stem member, said deflector cap having an annular array of wedge-shaped, flat deflector plates mounted to the underside thereof, each of said deflector plates having an outer wide end and an inner narrow end, the outer ends of the deflector plates being in substantial alignment proximate a peripheral edge of said deflector cap and the inner end of each of said deflector plates being hingedly attached to the deflector cap at a uniform radial distance from the center thereof;

a plurality of deflector plate adjustment mechanisms for individually adjusting a vertical position of the outer end of each of said deflector plates to thereby deflect the stream of water emitted by said rotating nozzle assembly to a desired distance as the rotating nozzle assembly passes beneath each of the deflector plates in turn, each of said deflector plate adjustment mechanisms being mounted between said deflector cap and an associated one of said deflector plates adjacent the outer end thereof, and each of said deflector plate adjustment mechanisms having an adjustment member accessible to the user on a top surface of said deflector cap;

an annular sheet of flexible material attached to the underside of said array of deflector plates for providing a smooth transition of said water stream as said rotating nozzle assembly passes each of said deflector plates in turn; and means for maintaining said deflector cap in a fixed arcuate position with respect to said frame member.

2. A rotary sprinkler as in claim 1 wherein said sheet of flexible material comprises mylar.

3. A rotary sprinkler as in claim 1 wherein said means for maintaining said deflector cap in a fixed arcuate position comprises:

a downwardly extending rod fixedly attached to said deflector cap; and an upwardly extending tube fixedly attached to said frame member for receiving said rod.

4. A rotary sprinkler as in claim 3 wherein:

said frame member comprises a housing member buried in the earth;

said rotating nozzle assembly and said deflector cap are responsive to water pressure applied to said rotary sprinkler for vertically rising from a non-operating position within said housing member to an operating position above said housing member; and said rod is arranged for sliding engagement within said tube.

5. A rotary sprinkler as in claim 1 wherein:

said frame member comprises a housing member buried in the earth; and said rotating nozzle assembly and said deflector cap are responsive to water pressure applied to said rotary sprinkler for vertically rising from a non-operating position within said housing member to an operating position above said housing member.

6. A method for watering irregularly-shaped areas, the method comprising:

providing a rotary sprinkler having a rotating nozzle assembly for emitting a stream of water outwardly from the sprinkler;

providing a circular deflector cap fixedly positioned on top of said said rotary sprinkler above said rotating nozzle assembly, said deflector cap having an annular array of wedge-shaped, flat deflector plates mounted to the underside thereof, each of said deflector plates having an outer wide end and an inner narrow end, the outer ends of the deflector plates being in substantial alignment proximate a peripheral edge of said deflector cap and the inner end of each of said deflector plates being hingedly attached to the deflector cap at a uniform radial distance from the center thereof, providing a plurality of deflector plate adjustment mechanisms, each of the deflector plate adjustment mechanisms being positioned between said deflector cap and the outer end of an associated one of said deflector plates, each of said deflector plate adjustment mechanisms being adjustable by the user for individually adjusting a vertical position of the outer end of each of said deflector plates to thereby deflect the stream of water emitted by said rotating nozzle assembly to a desired distance as the rotating nozzle assembly passes beneath each of the deflector plates in turn; and adjusting each of the deflector plate adjustment mechanisms to set the desired distance of the stream of water emitted by said rotating nozzle assembly at a rotational position corresponding to each of said deflector plates to thereby direct water onto the irregularly-shaped area.

* * * * *